US011466954B2

(12) United States Patent
Hughes et al.

(10) Patent No.: US 11,466,954 B2
(45) Date of Patent: Oct. 11, 2022

(54) FIREARM TRAINING METHOD AND APPARATUS

(71) Applicant: NextLevel Training LLC, Ferndale, WA (US)

(72) Inventors: Michael Frank Hughes, Maple Falls, WA (US); Britton R Lentz, Everson, WA (US); Thomas Ryan Swetish, Bellingham, WA (US)

( * ) Notice: Subject to any disclaimer, the term of this patent is extended or adjusted under 35 U.S.C. 154(b) by 320 days.

(21) Appl. No.: 16/775,327

(22) Filed: Jan. 29, 2020

(65) Prior Publication Data

US 2020/0278167 A1 Sep. 3, 2020

Related U.S. Application Data

(60) Provisional application No. 62/799,109, filed on Jan. 31, 2019.

(51) Int. Cl.
*F41A 33/00* (2006.01)
*F41A 33/02* (2006.01)

(52) U.S. Cl.
CPC ..... *F41A 33/02* (2013.01)

(58) Field of Classification Search
CPC ..... F41A 33/00; F41A 33/02; F41A 33/04; F41A 33/06; F41G 3/26
See application file for complete search history.

(56) References Cited

U.S. PATENT DOCUMENTS

2005/0188587 A1* 9/2005 Danas ..... F41C 23/10 42/72
2016/0084605 A1* 3/2016 Monti ..... A63F 13/285 463/2

* cited by examiner

*Primary Examiner* — Timothy A Musselman
(74) *Attorney, Agent, or Firm* — Michael F. Hughes

(57) ABSTRACT

A training pistol and method of providing the same having fixedly and adjustably removable base extensions to emulate the feel of a corresponding live fire pistol, a trigger mechanism configured to be fit in a compact pistol to provide a large number and sophistication of sear surfaces and biasing members such as helical springs and lasers into a compact pistol to provide training for an end user such as concealed carry holder or law enforcement personnel.

15 Claims, 7 Drawing Sheets

FIREARM TRAINING METHOD AND APPARATUS

CROSS REFERENCE TO RELATED APPLICATIONS

The present invention claims priority under 35 United States Code, Section 119 on the provisional application No. 62/799,109 filed on Jan. 31, 2019, the disclosure of which is incorporated by reference.

BACKGROUND

Technical Field of the Invention

Present invention relates to training system, and, more particularly, to a small and compact handgun/firearm training pistol and method.

Related Prior Arts

It is very desirous to have training systems that allow training with pistols, and, in particular, with small compact pistols in safe and effective manner. Challenge with small compact pistols is there are a plethora of small pistols and with frame tooling being so expensive, it is very difficult to model pistols after every single compact pistol on the market.

Therefore, a system that may allow for a trigger break system to be fit compactly within a training gun and further improvements related to base extensions which are interchangeable to substantially change the feel of a pistol may be some of the major requirement stand unattained for a long time.

Base extensions with different properties, in particular, front surfaces that extend down below the lower region of a frame have distinctly different feels of the pistol when grasped by a user. This feel is very significant whereby adjusting the natural point of aim, i.e. the ability to point the pistol with respect to the feel of gun and not necessarily using the sights of a pistol.

Therefore, there may be a need of having a single pistol but emulating multiple pistols with minimal amount of parts is an essential requirement, which may not only be cost effective for the end user to buy an affordably system but that can also provide various options that to be mixed and matched to emulate their particular live fire pistol of their choice.

SUMMARY

In one aspect of the present disclosure, a trigger mechanism is disclosed. The trigger mechanism may include a trigger member, a trigger bar and a transfer bar. The trigger member may rotationally mounted to a frame. The trigger bar may also be rotationally mounted to the frame. The trigger bar may include a first end and a second end wherein the first and second ends of the trigger bar are positioned opposite to a frame rotation point wherein the trigger bar is rotationally mounted to said frame. The transfer bar may rotationally attached to said trigger member. The transfer bar being rotationally attached to the first end of the trigger bar. Further, the second end of the trigger bar being attached to a sear bar. The sear bar may include a sear surface. Furthermore, a sear block may be moveably positioned in said frame having a sear block surface configured to be forcefully engaged with said sear surface of the sear bar. Rotation of the trigger member in a longitudinally rearward direction with respect to the frame places a compressive force upon the trigger member to rotate the first end of the trigger bar rearwardly and henceforth the second end of the trigger bar repositions in a forward direction with respect to the frame to bias the sear block in a forward direction with respect to the frame by way of pressure between the sear surface of the sear bar and the sear block surface of the sear block. Moreover, rotational movement of the trigger member biases the sear bar to eventually have the sear surface of the sear bar and the sear block surface disengages from one another to allow the sear bar to pass the sear block.

In one embodiment, a plane defined by the sear block surface may be substantially planar and the sear surface of the sear bar is further substantially planar, wherein when the sear surface of the sear bar and the sear block surface pass upon one another these planes no longer are substantially coplanar and will pass beyond one another creating a catastrophic break of the sear bar.

In one embodiment, the sear block may be biasingly engaged to the sear bar by way of forceful contact between the sear block surface and the sear surface of the sear bar by way of a sear helical spring.

In one embodiment, the sear bar may include a forward portion which may operatively be configured to engage a stop member when the trigger member is rotated into a fully rearward orientation with respect to the frame.

In one embodiment, the forward portion may be in forceful contact with the stop member this action closes a circuit to activate a shot-indicating laser.

In one embodiment, a first conductor may be in electrical communication with the sear bar and provides current to close a switch between a portion of the sear bar and the stop member, whereas the stop member comprises a conducting and electrical conducting portion which is operatively configured to engage the forward portion of the sear bar where the forward portion is electrically conductive and passes electric current from the first conductor to the electrically conducting portion of the stop member when the trigger member is in the fully rearward orientation with respect to the frame henceforth acting as a switch and allowing the current to pass to the shot-indicating laser.

In one embodiment, the trigger member and the trigger bar are each rotatably mounted to a trigger housing.

In one embodiment, the sear bar may be repositionally mounted within the trigger housing.

In one embodiment, the sear block may be configured to move in a substantially longitudinal direction within the trigger housing.

In one embodiment, the helical spring may be biased against a surface within the trigger housing and a mount surface of the trigger block, wherein said helical spring forcefully engages the sear block surface to the sear surface of the sear bar.

In one further aspect of the present disclosure, a firearm training pistol or apparatus may include a frame, a grip portion, base extensions (a first base extension, a second base extension), and a trigger member. The frame having an upper portion. The upper portion may be operatively configured to mount a slide thereto. The grip portion may be coupled to the frame and configured to be grasped by a user of the training pistol. the grip portion may include a grip upper region and a grip lower region. The grip lower region may include a first base extension. The first base extension may be configured to be fixedly attached to the grip lower region of the grip portion of the frame. Further, the second base extension may be operatively configured to be fixedly attached to the grip lower region by way of first removing the first base extension and thereafter the second base extension being operatively configured to mount thereto the grip lower region. the grip portion may include one or more grip modules in the form of the first and second base extension to emulate grip portions of the firearm training apparatus. Moreover, the trigger member may be moveably mounted to the frame at the portion.

In one embodiment, the trigger is rotationally mounted at the upper portion of the frame.

In one embodiment, the training pistol further comprises a third base extension operatively configured to be attached to the grip lower region of the frame when the first base extension and the second base extensions are not operatively attached to the grip lower region of the frame.

In one embodiment, the second base extension comprises a front surface and this front surface is substantially planar with respect to a front surface of the grip portion where the second base extension has a front surface having a concave arc with respect to a lateral axis and the grip portion has a front surface wherein a lower portion of the front surface of the third base extension extends longitudinally forward with respect to the frame compared to the upper portion of the third base extension, wherein the slide is fixedly attached to the frame at the upper portion.

In one embodiment, the frame and the slide are configured to house a trigger housing therein, wherein the trigger housing is operatively configured to house an upper portion of the trigger member and further rotatably mounts the trigger member to the trigger housing as well as said frame. Further, the trigger member may include a rotation mount operatively configured to rotatably mount a transfer bar to apply compressive force thereto the transfer bar when the trigger member is rotated in a longitudinally rearward direction with respect to the frame and said transfer bar is operatively configured to apply to be rotatably mount to a first end of a trigger bar which is rotatably mounted to the trigger housing. Furthermore, a second end of the trigger bar being operatively configured to reposition a sear bar having a sear surface. the sear surface configured to forcefully engage a sear block surface which is a part of a sear block that is repositionably mounted to the trigger housing, whereas longitudinal rearward travel of the trigger at a break point disengages the sear block surface of the sear block and the sear surface of the sear bar wherein allowing the sear bar to accelerate in a longitudinally forward direction, In one embodiment, the third base extension, the second base extension and the first base extension are all operatively configured to engage the grip lower region by way of a first laterally extending pin and second laterally extending pin which is configured to extend through a surface defining a hole in the grip lower region, and wherein the first and second laterally extending pins are operatively configured to extend through the frame at a second surface defining a hole.

In one embodiment, the first and second laterally extending pins are cylindrical having a central axis extending in the lateral direction with respect to the frame.

In one embodiment, the training pistol may be configured to have a shot-indicating laser contained therein and wherein when the said sear bar passes by the sear block a circuit closes activating the shot-indicating laser.

In one further aspect of the present disclosure, a firearm training pistol or apparatus may include a frame and a grip lower region. The frame may include an upper portion which mounts a slide thereto. The grip lower region may include a first base extension fixedly attached thereto, providing a trigger member rotatably mounted to the frame whereby having a prep location and a break location of the trigger with respect to the frame and further a fully longitudinally rearward location, whereby between the break location and the fully rearward location a shot-indicating laser is activated. The training pistol further being provided with an additional base extension that is operatively configured to be fixedly attached to the grip lower region when the first base extension is removed from the grip lower region. The additional base extension includes different characteristics with respect to a front surface of the additional grip attachment with respect to the additional base extension with respect to the first base extension whereby giving a distinct different feel to the user when the additional base extension is attached to the grip lower region with respect to the feel of the gun when the first base extension is fixedly attached to the grip lower region.

In one embodiment, the trigger may be adjustable to adjust the amount of force between a sear block surface of a sear block that forcefully engages a sear surface of the sear bar, and where the helical spring is repositioned at a base location closer to the sear block whereby increasing the force between the said sear surface of the sear bar and the sear block surface.

In one further aspect of the present disclosure, a firearm training apparatus may include a grip portion and a trigger mechanism. The grip portion may include one or more grip modules in the form of the first, second and third base extension to emulate the grip portion. Further, the trigger mechanism may be configured to the grip portion to activate a laser with emulated grip portion.

In yet further aspect of the present disclosure, a method for firearm training using a firearm training apparatus/pistol is provided. The method includes emulating a grip portion of the firearm training apparatus, wherein the grip portion having one or more grip modules to be accommodated in the grip portion. The grip module is in the form of a first third base extension, a second base extension and a third base extension. Further the method includes triggering a trigger mechanism to activate a laser with emulated grip portion having at least one of the first, second or third base extension.

This together with the other aspects of the present invention, along with the various features of novelty that characterize the present invention, is pointed out with particularity in the claims annexed hereto and forms a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

DESCRIPTION OF THE PREFERRED EMBODIMENTS

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

Figure 1:
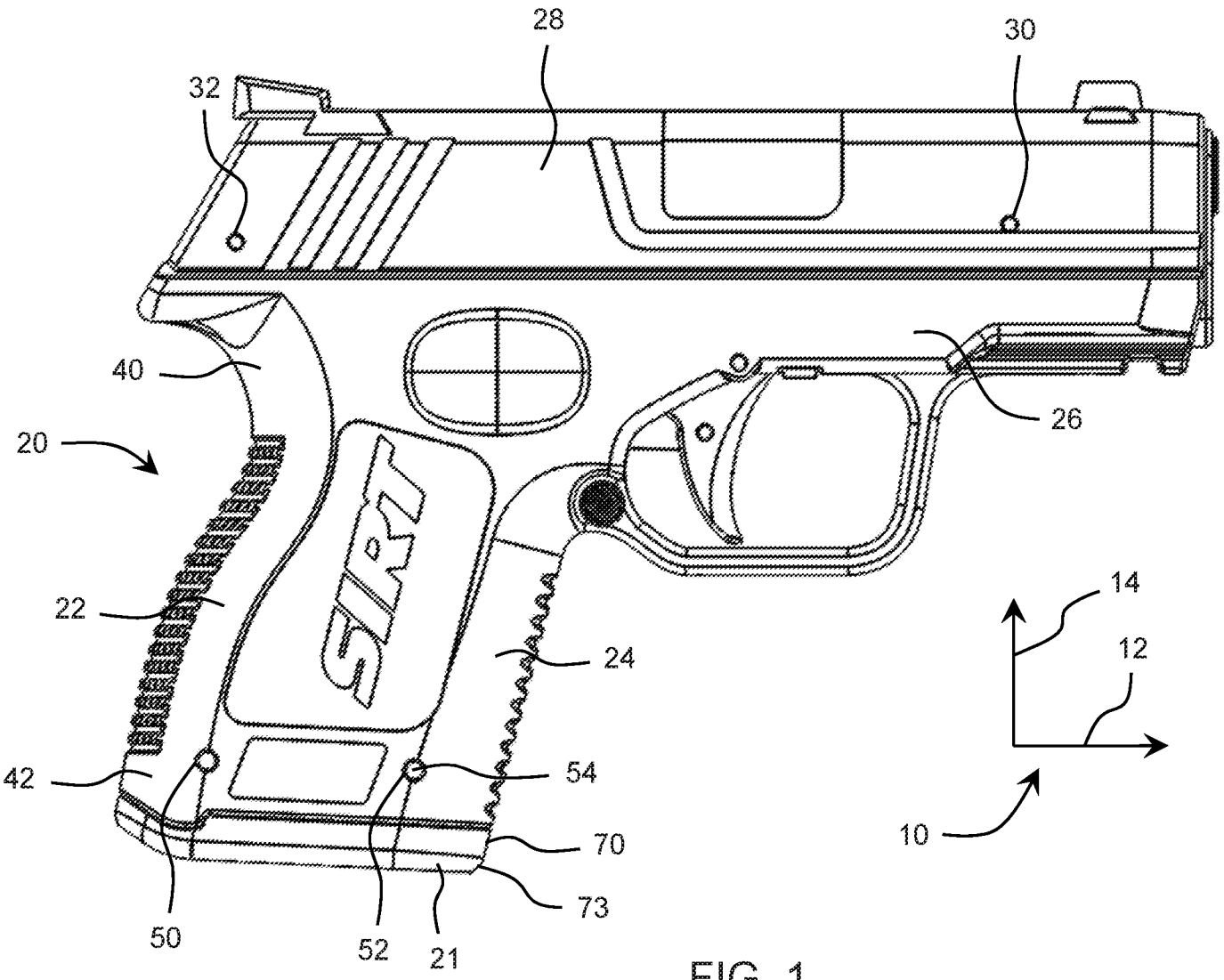
FIG. 1 shows a profile view of a training pistol, in accordance with an exemplary embodiment of the present disclosure.

Referring to FIG. 1, there is shown a training pistol 20, in accordance with an exemplary embodiment of the present disclosure. The training pistol 20 generally defined and orientated by way of referencing an axis system 10, as shown in the forward portion of FIG. 1.

The axis system 10, as shown, is used to generally orientate and describe the components of the training pistol 20 with respect to one another without being necessarily confined to one particular orientation. The axis system 10 has a longitudinal axis 12, where the arrow of the longitudinal axis 12 points in a longitudinally forward direction and the diametrically opposed direction is generally referred to as a longitudinally rearward direction. The axis system 10 also includes a vertical axis 14 that is generally aligned in what is referred to as a "vertical direction" or otherwise referred to as an upper direction. As further shown in FIG. 1, an axis substantially orthogonal to the longitudinal axis 12 and to the vertical axis 14 is defined as a lateral axis indicating a lateral direction. As further described herein, components of the training pistol 20 may rotate about a "lateral axis" meaning any lateral axis on the training pistol 20 which can define lateral rotation. Again such orientations and rotations are not absolute and for example could be degrees off in any of the other orthogonal directions but generally denote a direction to aid the description of the disclosure.

Still referring to FIG. 1, the training pistol 20 has a frame 22. The frame includes a grip portion 24. The frame 22 further includes an upper portion, generally denoted by numeral 26. Attached at the upper portion 26 is a slide 28. In one form, the slide 28 is fixedly attached to the upper portion 26 of the frame 22 by way of laterally extending pins 30 and 32.

Figure 6:
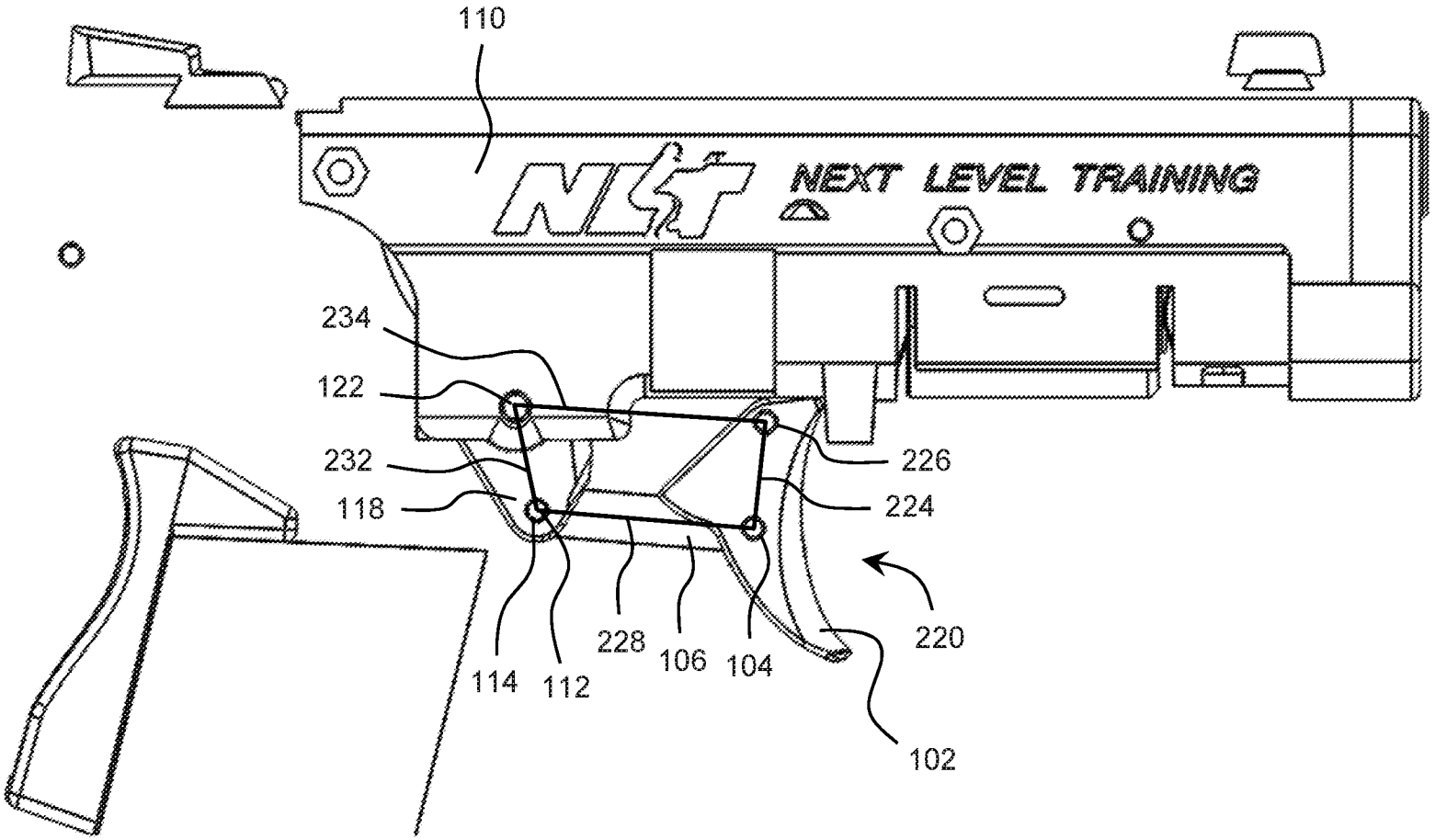
FIG. 6 shows a partial component view of the trigger housing, sights and further shows the four-bar linkage system with the transfer bar, in accordance with an exemplary embodiment of the present disclosure.
Figure 7:
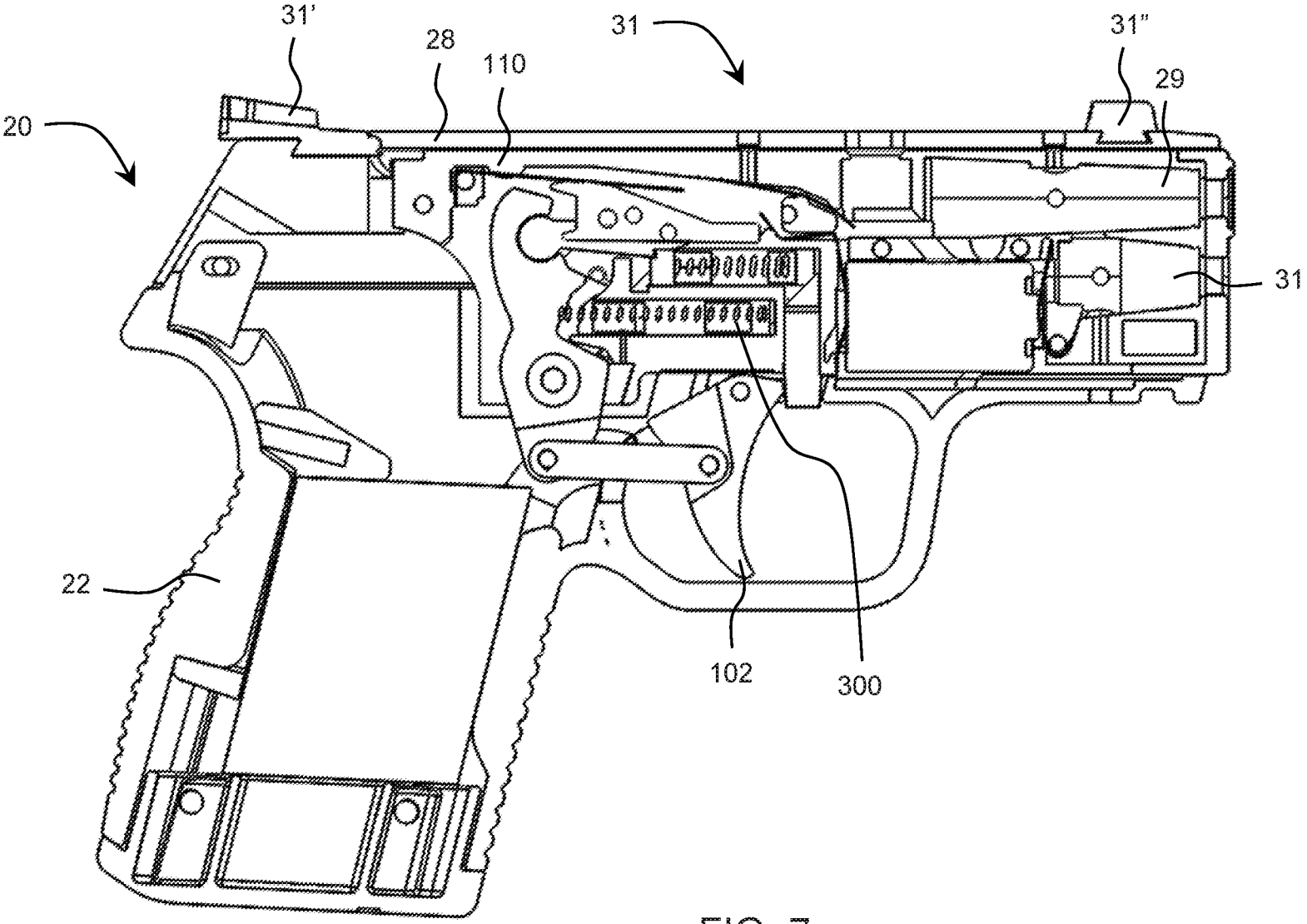
FIG. 7 shows a partial sectional view of the training pistol, in accordance with an exemplary embodiment of the present disclosure.

In one another arrangement of a training pistol, such as, the training pistol 20, as generally shown in FIG. 7, the training pistol 20 includes a frame, such as the frame 22, and a slide, such as the slide 28, operatively configured via sights 31 (comprising front and rear sights 31", 31') to be fixedly and removably attached to the slide 28. A laser 29 is mounted in the forward portion of the training pistol 20 and configured to emit a laser beam therefrom. The laser 29 is generally referred to as a shot-indicating laser. The trigger member 102, in one form, may be rotatably mounted to the frame 22, either, directly, or in some cases via a trigger housing 110. In one form, the trigger 102 may be directly mounted to the frame 22 and not to the trigger housing 110 (see FIG. 6).

Referring now back to FIG. 1, the grip portion 24 of the frame 22 has a grip upper region 40 and a grip lower region 42. The grip lower region 42, in one form, has a first laterally extending pin 50 extending therethrough. The grip lower region 42 has a surface defining an opening for the first laterally extending pin 50 to extend therethrough. In one form, in a similar manner as described in the previous sentence, there is a second laterally extending pin 52 which is operatively configured to extend in the lateral direction wherein a similar preferred form of attachment there is a second surface defining a hole 54 within the grip lower region 42, whereby allowing the second lateral extending pin 52 to pass therethrough. Therefore, the pins 50 and 52 extend through the grip portion 24 and further through the surfaces defining openings within a first base extension 21.

Figure 2:
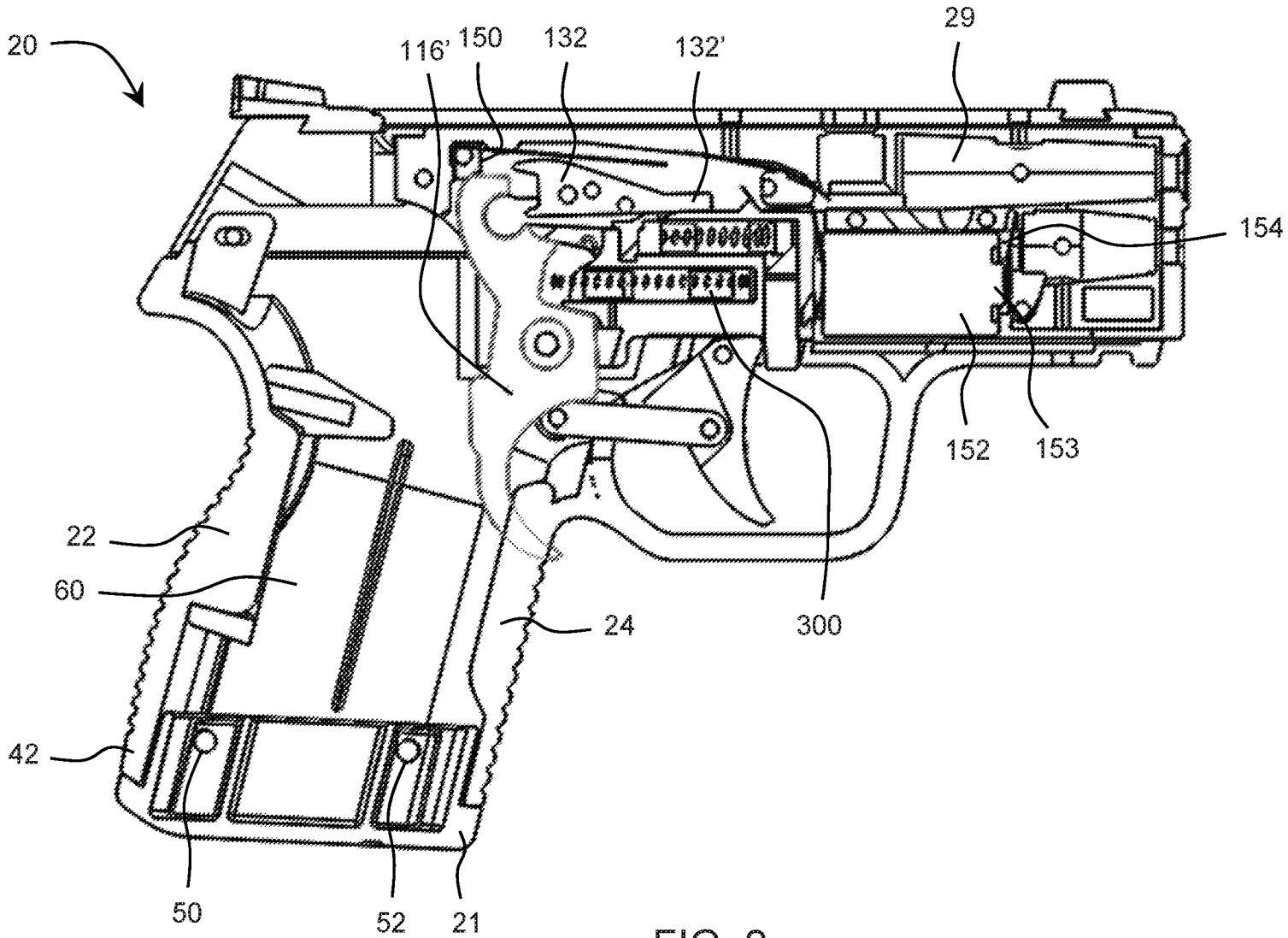
FIG. 2 shows a partial sectional view of a training pistol showing one half thereof and further showing in part how a trigger bar is modified from a trigger housing of a full frame pistol, in accordance with an exemplary embodiment of the present disclosure.

Now, referring to FIG. 2, there is shown a partial sectional view of the training pistol 20. As shown in FIG. 2, the first base extension 21 is fixedly attached to the grip lower region 42 whereby the first and second laterally extending pins 50 and 52 extend surfaces defining openings within all of the base extensions but as shown in FIG. 2, the first base extension 21.

As can be seen in FIG. 2, the frame 22 further includes a surface defining an interior weight cavity 60. The surface defining the interior weight cavity 60 is operatively configured to contain a weight therein, such as a steel weight or something of similar density. In general, the surface defining the interior weight cavity 60 can be arranged by way of dimensions to fit common bar stock of steel for ease of cost and simplicity of creating a weight by simply using a bandsaw to cut a weight and place it in this cavity area to supply additional weight to the training pistol 20.

Figure 3:
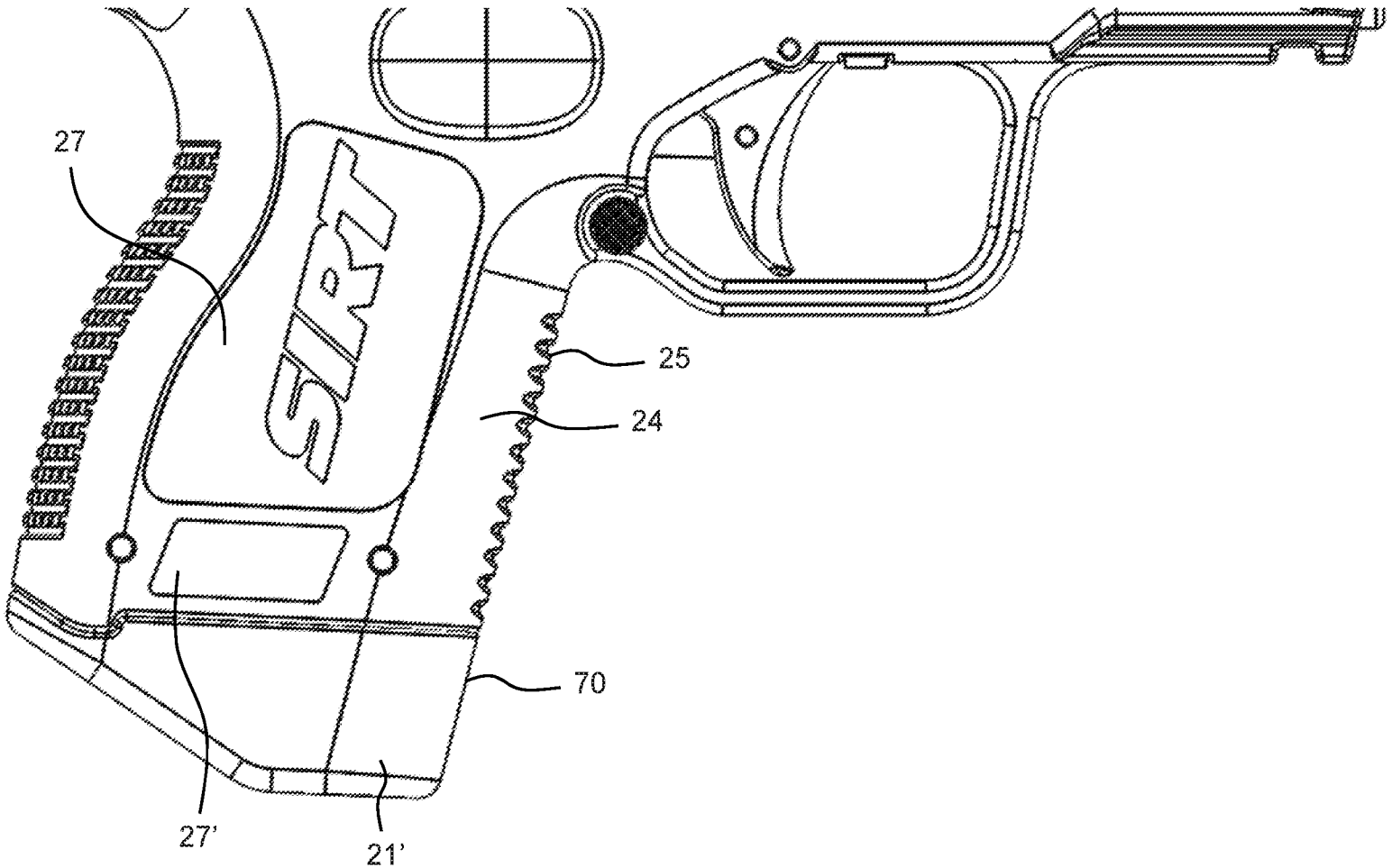
FIG. 3 shows a lower portion of a frame whereby a second base extension is attached thereto and how the front surface of the second base extension is substantially lined up with the front surface of the grip portion, in accordance with an exemplary embodiment of the present disclosure.

Now, referring to FIG. 3, there is shown a second base extension 21'. The second base extension has a front surface 70' which is substantially planar to a front surface 25 of the grip portion 24.

The grip portion 24 further has a lateral portion 27 which is provided to have insignia placed thereon, such as markings like the trademark SIRT for SIRT training pistol. Further in one form, there is a recessed cavity 27' configured in the grip portion 24, which may recess a few thousandths of an inch to allow a decal to be placed therein, such as a serial number. Having a recessed cavity 27' is useful because it provides a mount region for a decal and remains protected therein since the recessed cavity 27' is positioned laterally inward with respect to the material of the frame 22 immediately therearound.

Figure 4:
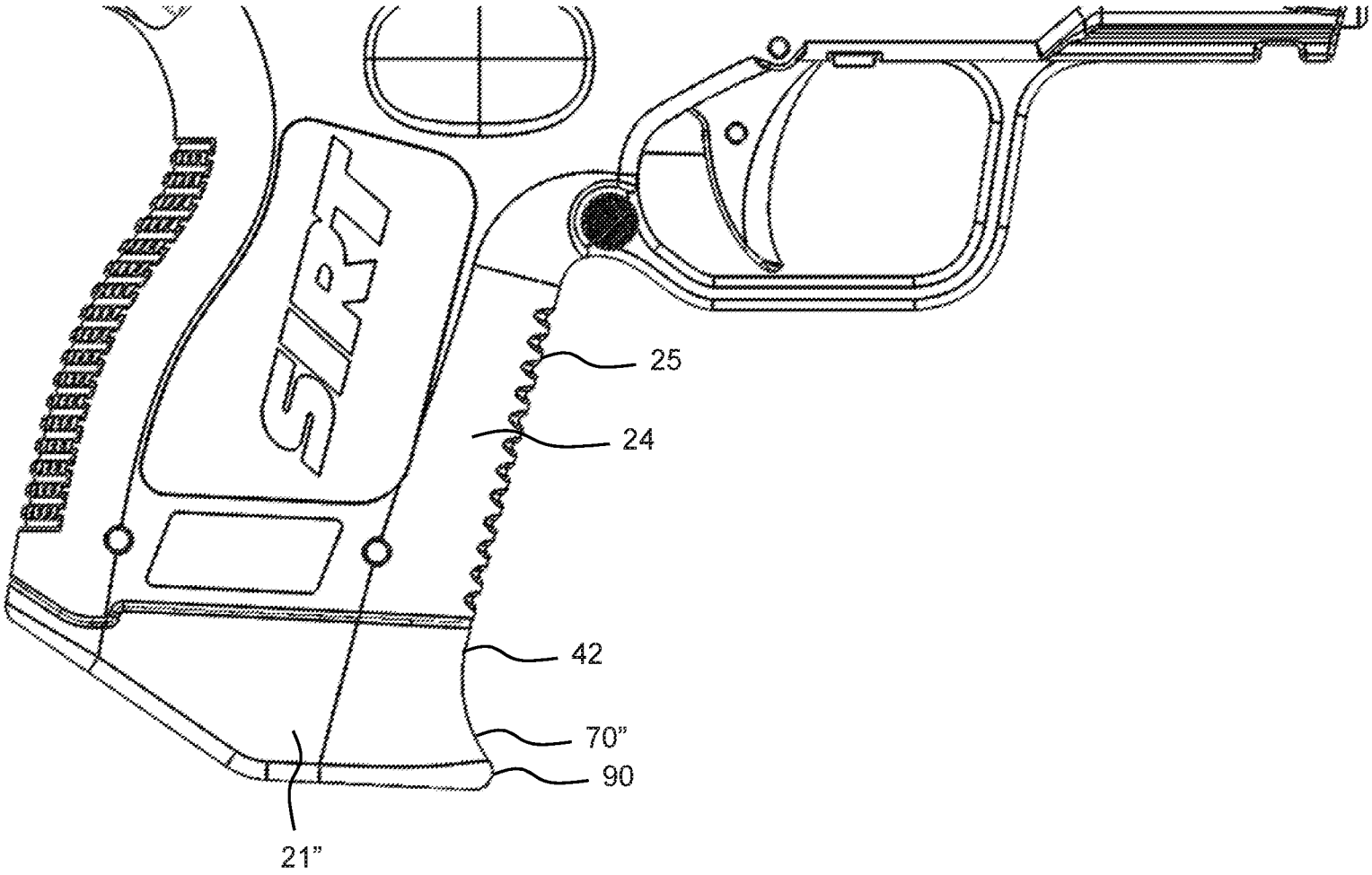
FIG. 4 shows a lower view having a third base extension fixedly attached to the grip lower region whereby the front surface has a lower point that extends longitudinally forward with respect to the front surface of the grip portion of the frame, in accordance with an exemplary embodiment of the present disclosure.

Now referring to FIG. 4, there is shown an additional base extension, herein referred to as a third base extension 21". The third base extension 21" has a lower point 90. The lower point 90 is a part of a front surface 70". The lower portion 90 sits vertically opposite of an upper portion front surface 92 which is generally aligned with the front surface 25 of the grip portion 24. In other words, the surface 25 abut against and is substantially aligned to the upper portion front surface 92 but the front surface 70" is generally concave about a lateral access and the lower portion 90 extends longitudinally forward with respect to the upper portion front surface 92. This concave surface of the third base extension 21" provides a hooked-like surface to engage the pinkie of the shooter whereby giving a very distinct feel, for example, with respect to the second base extension 21, as shown in FIG. 3. The front surface 70' of FIG. 3 is more in lined when looking along a lateral axis with respect to the front surface 25. This second base extension 21 can emulate, for example, live fire guns that have a magazine extension for example that extend out of the lower portion of a frame of a live fire gun.

As can be seen in FIG. 1, how the first base extension 21 has a small if any front surface 70 whereby generally speaking depending on the hand of the shooters the pinkie of the shooter will extend at the very corner edge 73 of the front surface 70 or hang completely off the training pistol 20. Due to such arrangement, the grip lower region 42 as shown in FIG. 1, has a very distinct feel for an end user with respect to the second base extension 21' what is shown in FIG. 3 and to the third base extension 21" as shown in FIG. 4.

All of these different orientations of base extensions 21, 21'and 21" have a very different unique feel for the natural point of aim of a shooter. The natural point of aim is where the shooter can align the pistol based on the feel of the gun and it has been found that different base extensions have a very substantial influence for a training gun to build and train the natural point of aim. In one form, a training pistol 20 can be provided with all three or two out of the three of the base extensions 21, 21' and 21" and the end user can easily change these base extensions 21, 21' or 21" by simply punching. Alternatively, either of the base extensions 21, 21' 21" can otherwise may be changed by removing the first and second laterally extending pins 50 and 52. In doing so, one of the said base extensions may be removed by simply removing the lateral pins 50 and 52, and other base extension may be repositioned therein and having lateral pins 50 and 52, as one form of a mounting system, to fixedly attached the new or changed base extension to the grip lower region 42 of the frame 22.

Figure 5:
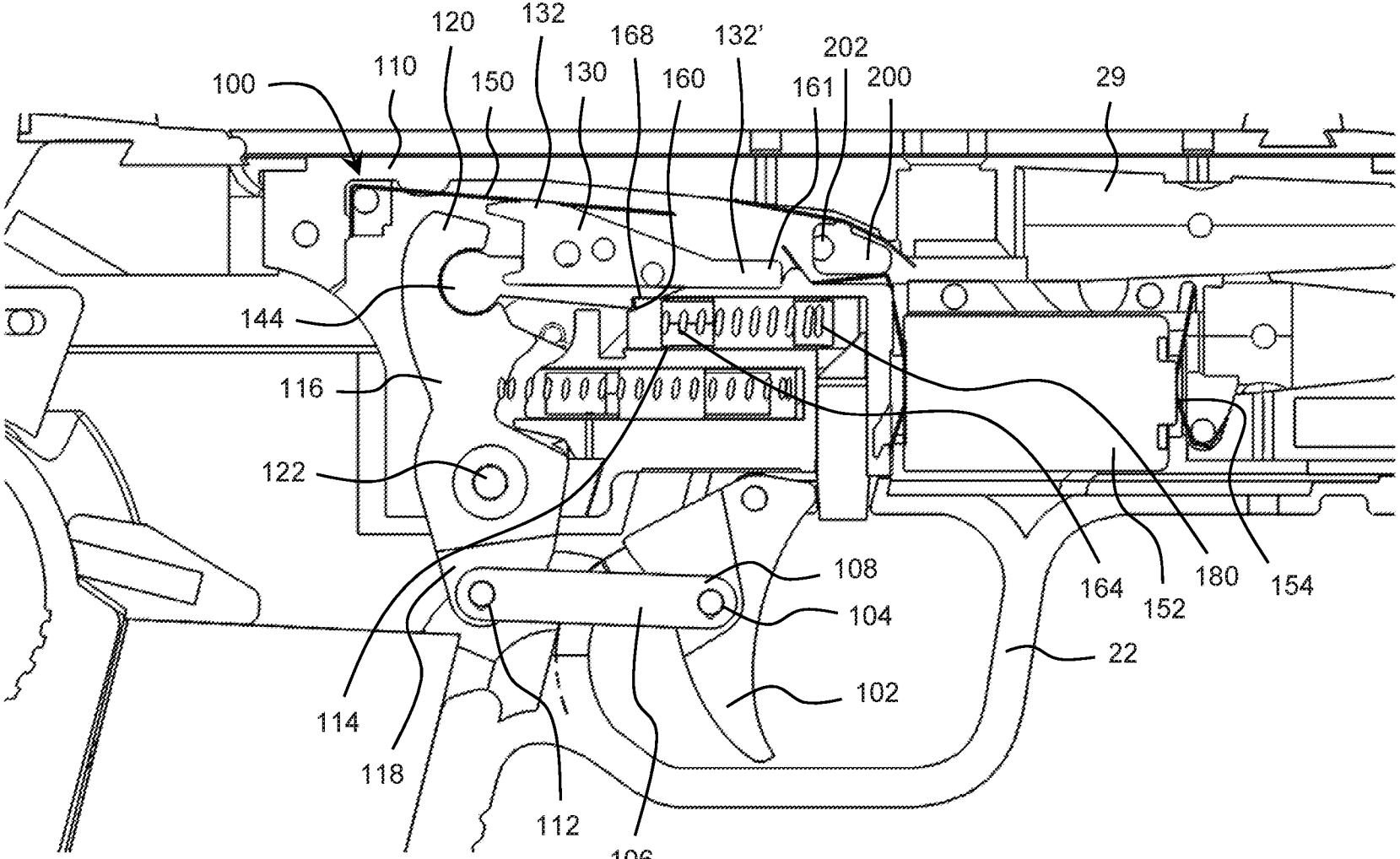
FIG. 5 shows a close-up view of the internal portion in a partial cut-away showing the inner operation of the trigger mechanism, in accordance with an exemplary embodiment of the present disclosure.

The foregoing description will now be discuss with respect to FIG. 5 and talk about some of the internal mechanisms of the training pistol 20, whereby in general a trigger mechanism 100 provides a system to allow a sophisticated break mechanism and switch to activate a shot-indicating laser in a small compact training pistol.

As shown in FIG. 5, it should first be noted this is a partial sectional view of the training pistol 20. The frame 22 provides a mounting point either directly or indirectly to a trigger member 102. In other words, in one form, the trigger member 102 can be rotatably mounted directly to the frame 22, as shown in FIG. 5, or indirectly mounted to the frame via trigger housing 110, as shown in FIG. 6.

As can be seen in FIG. 5, the trigger mechanism 100 is configured to include the trigger member 102, a transfer bar 106 and a trigger bar 116. The trigger member 102 has a rotation mount 104 which is operatively configured to rotatably mount to the transfer bar 106. The transfer bar 106 has first and second longitudinal ends 108 and 112. Further, the trigger bar 116 includes a first end 118 and a second end 120 opposite to each other. The second longitudinal end 112 of the transfer bar 106 is rotatably mounted at a mount portion 114 to the first end 118 of the trigger bar 116. In between the first end 118 and the second end 120 of the trigger bar 116, there is a frame rotation point 122 whereby the trigger bar 116 is rotatably mounted about a lateral axis at the frame rotation point 122. In one form, the frame rotation point 122, as shown in FIG. 6, is rotatably mounted by a cross pin which in one preferred form, is attached to the trigger housing 110.

The trigger mechanism 100 further configures a sear bar 130 rotatably mounted at the second end 120 of the trigger bar 116. The sear bar 130 has a conductive surface, in one form, which can be an over-molded piece of metal around a plastic such as seal. The conductive surface, herein referred to by 'Numeral 132', is operatively engaged to forcefully make contact to a first conductor 150. In one form, the first conductor 150 has a current supplied thereto from a battery 152. In one form, a wire can be soldered to a battery contact 154 and provide current to the first conductor 150.

The sear bar 130 includes a base 144, which in one form, can be a cylindrical type attachment, attached to the second end 120 of the trigger bar 116. In one form, the base 144 has an outer surface which is a substantially cylindrical member that can slide about a lateral axis for ease of assembly to attach the sear bar 130 to the trigger bar 116. As noted in FIG. 6, when the trigger bar 116 (shown in FIG. 5) and sear bar 130 (shown in FIG. 5) are housed within the trigger bar housing 110, they cannot substantially move laterally to disengage from one another whereby are moveably attached thereto with respect to one another.

Further, as seen in FIG. 5, the sear bar 130 has a sear surface 160. The sear surface 160 is operatively configured to engage a sear block surface 168 of a sear block 164. The sear block 164 is moveably attached in one form to extend in a substantially longitudinal direction whereby the sear block 164 comprises the sear block surface 168 which as noted above can be substantially planar and as noted above can forcefully engage the sear surface 160. Therefore, at this point it can be understood that when the trigger member 102 rotates in a longitudinally rearward direction applying force to the trigger bar 106, as shown in FIG. 5, the trigger bar 116 will rotate in a clockwise direction (again in the configuration and view of FIG. 5) whereby biasing the sear bar 130 longitudinally forward.

The trigger member 102 has a prep location whereby when the sear surface 160 engages the sear block surface 168. This occurs when the trigger member 102 rotates longitudinally rearwardly a small degree with respect to a fully forward rest position. As the trigger member 102 continues to reposition longitudinally rearwardly, the lower tip of the sear surface 160 disengages from the upper tip area of the sear block surface 168. As soon as these two surfaces 160, 168 disengage from one another, this is herein referred to as the break location. Because the sear block 164 has to move longitudinally forward henceforth compressing a helical spring 180, energy is released from the helical spring 180 violently repositioning the sear block 164 forward as interned, the sear bar 130 will now rapidly accelerate in a longitudinally forward direction. In a one form, the forward portion 161 of the sear bar 130 will bias very quickly forward and in one form hit a stop member 200.

The stop member 200 in one form has an electrically conductive portion 202 whereby the conductive surface 132 has a forward portion 132' that forcefully engages the electrically conductive portion 202 to close the circuit to provide current to a shot-indicating laser 29 (see FIG. 2). The shot-indicating laser 29, as shown in FIG. 2, has an electrical lead which is attached to a negative portion of a conventional battery 152. And as noted above, the positive area 153 of the battery 152 is in electrical communication with the first conductor 150. In one form a wire alongside the back side of the housing 110 as shown in FIG. 6 can be soldered to a battery contact 154 which is in electrical communication to the positive area 153 of the battery 152.

Referring back now to FIG. 2, electrical current, preferably a direct current, from a battery can pass from the first conductor 150 to the conductive surface 132 of the sear block 164, and the forward portion 132' can forcefully engage the stop member 200 thereby closing the circuit where the stop member 200, more specifically, the electrically conductive portion 202 is attached to the hot lead of the laser 29. Therefore, it can be appreciated when the trigger member 102 repositions longitudinally forwardly, the linkage between the trigger member 102, transfer bar 106, trigger bar 116 and the sear bar 130 are such so ultimately the sear bar 130 repositions longitudinally rearwardly and ceases to conduct current to ultimately the laser 29.

As shown in FIG. 7, there are sights 31 which are comprised of a rear sight 31' and a front sight 31". In one form, the slide 28 has surfaces defining slots therein to allow slides to be easily slid about a lateral axis to be mounted to the slide 28.

Now referring to FIG. 6, there will be a general discussion of the fundamental concept of the linkage system. FIG. 6 shows the exterior of the trigger housing 110 but is actually useful to describe the four-bar linkage phenomena of a lower trigger system 220. As noted before, the lower trigger system 220 comprised the trigger member 102 mentioned previously, the vector 224 represents the center of rotation of the trigger member 102 where mounted to the frame at location 226 and the rotational mount 104. Further, the transfer bar 106 defines the second vector 228. The second vector 228 is defined between the rotational mount 104 and the mount portion 114. Moreover, the third vector 232 is defined by the frame rotation 122 and the second longitudinal ends 112.

Finally, between the rotational mount portions 226 and 122 is defined a base vector 234. Base vector 234 is fixedly and rigidly attached to the frame 22 and is considered the stationary vector for purposes of analyzing a four-bar linkage. Therefore, it can be appreciated that when the trigger member 102 is repositioned longitudinally rearwardly, the vector 224 rotates in a clockwise direction. Further, the vector 232 will rotate in a clockwise direction by way of being pivotally attached to the vector 228. Therefore, it can be appreciated that these four vectors create a conventional compliant mechanism referred to as a four-bar linkage. In one form, the vector 232 is shorter than the vector 224 creating a unique leverage point and hence the ultimate feel of the break between the sear surfaces (now refer back to FIG. 5) 160 and the sear block surface 168 will have a unique and distinct feel as opposed to when the trigger bar 116 is rotated as a trigger itself.

In other words, as can be seen in FIG. 2, how there is a superimposed trigger bar 116' which is not an operable trigger bar in the embodiment of FIG. 2 but rather shows one way to make a trigger mechanism with the lower portion of the trigger bar 116' is actually triggering itself for purposes of demonstration. However, it can be appreciated that this orientation would not work in a compact pistol henceforth a four-back linkage as described earlier in this passage and shown in detail schematically in FIG. 6 allows for the entire orientation of all the parts to be generally positioned longitudinally rearwardly allowing for a compact training pistol having all the sophisticated designs of the helical springs, sear blocks and internal lasers and battery supply contained therein for an innovative and effective training system.

It should further be noted that the helical spring 300 is provided as a take-up force to bias the trigger bar (the upper portion thereof) longitudinally rearwardly. It should be further noted that a take-up laser 33 is provided in the preferred form of the embodiment which allows for laser to be activated when the trigger is in the prepped position as mentioned above.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the present disclosure.

What is claimed is:

1. A trigger mechanism, comprising: a trigger member rotationally mounted to a frame, a trigger bar rotationally mounted to the frame, the trigger bar having a first end and a second end, wherein the first and second ends of the trigger bar are positioned opposite to a frame rotation point wherein the trigger bar is rotationally mounted to said frame, a transfer bar rotationally attached to said trigger member, the transfer bar being rotationally attached to the first end of the trigger bar, a. the second end of the trigger bar being attached to a sear bar, the sear bar having a sear surface, b. a sear block moveably positioned in said frame having a sear block surface configured to be forcefully engaged with said sear surface of the sear bar, c. wherein rotation of the trigger member in a longitudinally rearward direction with respect to the frame places a compressive force upon the trigger member to rotate the first end of the trigger bar rearwardly and henceforth the second end of the trigger bar repositions in a forward direction with respect to the frame to bias the sear block in a forward direction with respect to the frame by way of pressure between the sear surface of the sear bar and the sear block surface of the sear block, and d. wherein rotational movement of the trigger member biases the sear bar to eventually have the sear surface of the sear bar and the sear block surface disengages from one another to allow the sear bar to pass the sear block.

2. The trigger mechanism of claim 1, wherein a plane defined by the sear block surface is substantially planar and the sear surface of the sear bar is further substantially planar, wherein when the sear surface of the sear bar and the sear block surface pass upon one another these planes no longer are substantially coplanar and will pass beyond one another creating a catastrophic break of the sear bar.

3. The trigger mechanism of claim 1, wherein the sear block is biasingly engaged to the sear bar by way of forceful contact between the sear block surface and the sear surface of the sear bar by way of a sear helical spring.

4. The trigger mechanism of claim 1, wherein the sear bar has a forward portion which is operatively configured to engage a stop member when the trigger member is rotated into a fully rearward orientation with respect to the frame.

5. The trigger mechanism of claim 4, wherein the forward portion is in forceful contact with the stop member this action closes a circuit to activate a shot-indicating laser.

6. The trigger mechanism of claim 5, wherein a first conductor is in electrical communication with the sear bar and provides current to close a switch between a portion of the sear bar and the stop member, whereas the stop member comprises a conducting and electrical conducting portion which is operatively configured to engage the forward portion of the sear bar where the forward portion is electrically conductive and passes electric current from the first conductor to the electrically conducting portion of the stop member when the trigger member is in the fully rearward orientation with respect to the frame henceforth acting as a switch and allowing the current to pass to the shot-indicating laser.

7. The trigger mechanism of claim 6, wherein the trigger member and the trigger bar are each rotatably mounted to a trigger housing, and the sear bar is repositionally mounted within the trigger housing, and that the sear block is configured to move in a substantially longitudinal direction within the trigger housing.

8. The trigger mechanism of claim 7, wherein the helical spring is biased against a surface within the trigger housing and a mount surface of the trigger block, wherein said helical spring forcefully engages the sear block surface to the sear surface of the sear bar.

9. A firearm training pistol comprising:

a. a frame, the frame having an upper portion, the upper portion operatively configured to mount a slide thereto, b. a grip portion, the grip portion coupled to the frame and configured to be grasped by a user, the grip portion having a grip upper region and a grip lower region, the grip lower region having a first base extension, the first base extension configured to be fixedly attached to the grip lower region of the grip portion of the frame, c. a second base extension operatively configured to be fixedly attached to the grip lower region by way of first removing the first base extension and thereafter the second base extension being operatively configured to mount thereto the grip lower region, the grip portion having one or more grip modules in the form of the first and second base extension to emulate grip portions of the firearm training pistol;

d. a third base extension operatively configured to be attached to the grip lower region of the frame when the first base extension and the second base extensions are not operatively attached to the grip lower region of the frame;

e. a trigger member moveably mounted to the frame, wherein the trigger member is rotationally mounted at the upper portion of the frame, wherein the second base extension comprises a front surface, the front surface of the second base extension is substantially planar with respect to a front surface of the grip portion where the second base extension has a front surface having a concave are with respect to a lateral axis and the grip portion has a front surface wherein a lower portion of the front surface of the third base extension extends longitudinally forward with respect to the frame compared to the upper portion of the third base extension, wherein the slide is fixedly attached to the frame at the upper portion.

10. The firearm training pistol of claim 9, wherein the frame and the slide are configured to house a trigger housing therein wherein the trigger housing is operatively configured to house an upper portion of the trigger member and further rotatably mounts the trigger member to the trigger housing as well as said frame, a. the trigger member having a rotation mount operatively configured to rotatably mount a transfer bar to apply compressive force thereto the transfer bar when the trigger member is rotated in a longitudinally rearward direction with respect to the frame and said transfer bar is operatively configured to apply to be rotatably mount to a first end of a trigger bar which is rotatably mounted to the trigger housing, b. a second end of the trigger bar being operatively configured to reposition a sear bar having a sear surface, the sear surface configured to forcefully engage a sear block surface which is a part of a sear block that is repositionably mounted to the trigger housing, c. whereas longitudinal rearward travel of the trigger at a break point disengages the sear block surface of the sear block and the sear surface of the sear bar wherein allowing the sear bar to accelerate in a longitudinally forward direction.

11. The firearm training pistol of claim 9, wherein the third base extension, the second base extension and the first base extension are all operatively configured to engage the grip lower region by way of a first laterally extending pin and second laterally extending pin which is configured to extend through a surface defining a hole in the grip lower region, and wherein the first and second laterally extending pins are operatively configured to extend through the frame at a second surface defining a hole.

12. The firearm training pistol of claim 11, wherein the first and second laterally extending pins are cylindrical having a central axis extending in the lateral direction with respect to the frame.

13. The firearm training pistol of claim 12, wherein the training pistol is configured to have a shot-indicating laser contained therein and wherein when the said sear bar passes by the sear block a circuit closes activating the shot-indicating laser.

14. A firearm training pistol comprising:

a. a frame having an upper portion which mounts a slide thereto, b. a grip lower region having a first base extension fixedly attached thereto, providing a trigger member rotatably mounted to the frame whereby having a prep location and a break location of the trigger with respect to the frame and further a fully longitudinally rearward location, c. whereby between the break location and the fully rearward location a shot-indicating laser is activated, d. the training pistol further being provided with an additional base extension that is operatively configured to be fixedly attached to the grip lower region when the first base extension is removed from the grip lower region, e. whereby the additional base extension has different characteristics with respect to a front surface of the additional grip attachment with respect to the additional base extension with respect to the first base extension whereby giving a distinct different feel to a user when the additional base extension is attached to the grip lower region with respect to the feel of the gun when the first base extension is fixedly attached to the grip lower region.

15. The firearm training pistol of claim 14, wherein the trigger is adjustable to adjust the amount of force between a sear block surface of a sear block that forcefully engages a sear surface of the sear bar, and where the helical spring is repositioned at a base location closer to the sear block whereby increasing the force between the said sear surface of the sear bar and the sear block surface.

* * * * *